US009877537B2

(12) United States Patent
Berberian

(10) Patent No.: US 9,877,537 B2
(45) Date of Patent: Jan. 30, 2018

(54) SHOE WITH A HIGH HEEL TO LOW HEEL CONVERSION

(71) Applicant: Maria Mercedes Berberian, Vancouver, WA (US)

(72) Inventor: Maria Mercedes Berberian, Vancouver, WA (US)

( * ) Notice: Subject to any disclaimer, the term of this patent is extended or adjusted under 35 U.S.C. 154(b) by 65 days.

(21) Appl. No.: 14/876,576

(22) Filed: Oct. 6, 2015

(65) Prior Publication Data

US 2017/0095029 A1 Apr. 6, 2017

(51) Int. Cl.
*A43B 3/24* (2006.01)
*A43B 21/36* (2006.01)

(52) U.S. Cl.
CPC ..... *A43B 3/24* (2013.01); *A43B 21/36* (2013.01)

(58) Field of Classification Search
CPC ..... A47B 3/24; A47B 3/244; A47B 3/246; A47B 3/248; A47B 3/26; A47B 7/28; A47B 13/10; A47B 13/12; A47B 13/28; A47B 13/30; A47B 13/32; A47B 13/34; A47B 13/36; A47B 13/41; A47B 21/36; A47B 21/37; A47B 21/38; A47B 21/39; A47B 21/40; A47B 21/42; A47B 21/433; A47B 21/437
USPC ..... 36/100, 107, 108
See application file for complete search history.

(56) References Cited

U.S. PATENT DOCUMENTS 2,112,052 A * 3/1938 Smith ..... A43B 3/26 36/100
2,258,265 A * 10/1941 Schwartz ..... A43B 21/433 36/100
2,943,404 A * 7/1960 Sultan ..... A43B 21/36 36/42
4,670,996 A * 6/1987 Dill ..... A43B 21/50 36/36 C
4,805,320 A * 2/1989 Goldenberg ..... A43B 1/0054 36/36 R
5,133,138 A * 7/1992 Durcho ..... A43B 21/36 36/100
5,309,651 A * 5/1994 Handel ..... A43B 21/433 36/100
5,347,730 A * 9/1994 Rodriguez Colon .... A43B 3/24 36/100
6,631,570 B1 * 10/2003 Walker ..... A43B 3/24 36/100
9,220,317 B2 * 12/2015 Green ..... A43B 13/04
2008/0244931 A1 * 10/2008 Gallegos ..... A43B 1/0081 36/100
2010/0139123 A1 * 6/2010 Alan ..... A43B 3/24 36/100

(Continued)

FOREIGN PATENT DOCUMENTS

FR 3005243 A1 * 11/2014 ..... A43B 13/12

*Primary Examiner* — Joshua E Rodden
(74) *Attorney, Agent, or Firm* — Kolisch Hartwell, P.C.

(57) ABSTRACT

A shoe that is convertible between a high heel mode and a low heel mode. There is a rigid shank that is adjustable along the longitudinal axis of the shoe between the various layers of the sole. The proximal end of the adjustable shank may be slid further under the metatarsophalangeal joints to accommodate the sweeping higher arch of a high-heeled shoe or the distal end of the adjustable shank may be slid closer to the back of the calcaneus bone to reduce the arch of the shoe. The different height heels are lockably affixed to the sole.

7 Claims, 6 Drawing Sheets

(56) References Cited

U.S. PATENT DOCUMENTS

2016/0198795 A1* 7/2016 Lopez-Velasquez .... A43B 3/24
36/100

* cited by examiner

FIG. 1
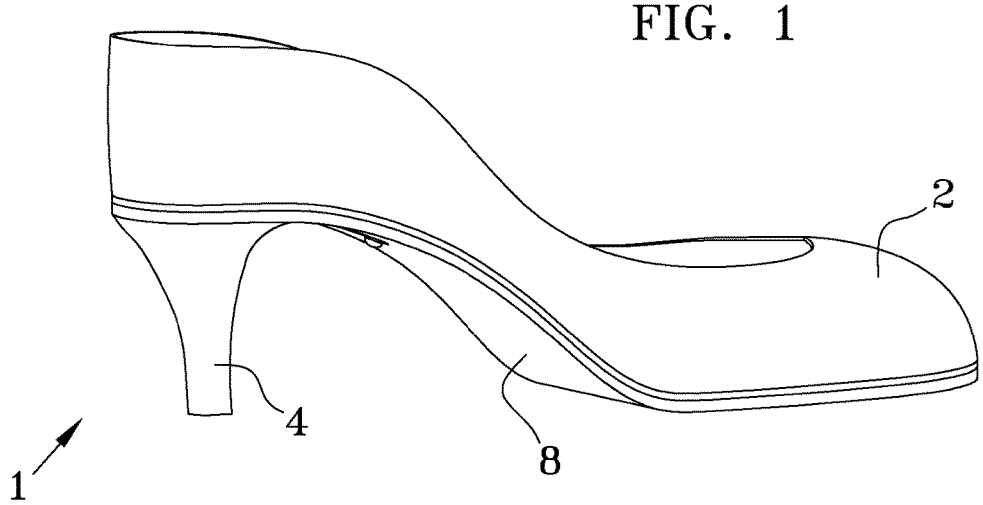
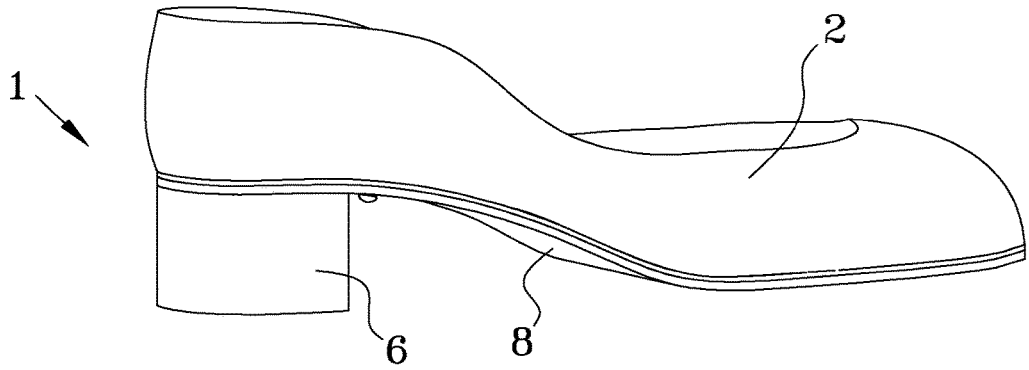
FIG. 2

SHOE WITH A HIGH HEEL TO LOW HEEL CONVERSION

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Style and comfort do not always go hand in hand. This is especially true when it comes to women's footwear. High heels, though a mainstay in most women's closets, fall short of being reasonably designed footwear. The height difference between the front and rear of these shoes causes wobbling and slipping even on unadorned, planar surfaces. Despite this, women continue to wear these fashion statements even though the original purpose of high heels, that of helping a rider secure their stance in the stirrups so they could shoot arrows more effectively from horseback, no longer exists. Through the years, high heels evolved into stilettos and pumps and have succumb to iconic branding such that many see such shoes as status symbols for success and perhaps femininity.

Unfortunately, continued use of elevated footwear leads to a plethora of physical problems manifesting itself in such things as planter fasciitis and neuroma while affecting other areas of the body such as the calves, knees and lower back. The American Podiatric Medical Association reports that women have four times as many foot issues as do men. High heels are dangerous to walk in and are subject to immediate frictional engagement with sidewalk grates and the like. The most common complaint about high heels is that they are slow and uncomfortable to walk in. For this reason many working women carry a second pair of shoes, ones with a low heel or a shoe of a walking/running variety, to get them to and from the workplace. Since shoes accumulate dirt in use, this strategy not only requires one to carry a second set of shoes, it also requires a bag in which to transport them. For most women who carry a purse, this means both arms are full. The situation is worsened if there is a personal computing device such as a laptop computer or tablet that also must be transported daily to work.

Henceforth, a single pair of shoes that could be converted between a fashionable high and a comfortable low heel would fulfill a long felt need in the footwear industry. This new invention utilizes and combines known and new technologies in a unique and novel configuration to develop a convertible shoe that overcomes the aforementioned problems and provides a solution to a common workplace dilemma.

SUMMARY OF THE INVENTION

The general purpose of the present invention, which will be described subsequently in greater detail, is to provide a shoe (for either sex), capable of rapid and simple conversion between a high heeled configuration to a low heeled configuration and vice versa. To accomplish this end there is not a specific look or outer design to the footwear, but rather a generic mechanical mechanism that facilitates the conversion and can be imbedded within each of a pair of fashionable shoes, and which is externally accessible. This will be addressed herein.

The present invention has many of the advantages mentioned heretofore and many novel features that result in a new convertible shoe and its method of making which are not anticipated, rendered obvious, suggested, or even implied by any of the prior art, either alone or in any combination thereof.

In accordance with the invention, an object of the present invention is to create a convertible, height adjustable shoe that may be rapidly and simply changed from a high heel to a low heel design.

It is another object of this invention to provide a generic design for a shoe that may be safely modified in height.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

FIG. 1 is a side perspective view of the convertible shoe in the high heeled mode;

FIG. 2 is a side perspective view of the convertible shoe in the low heeled mode;

DEFINITIONS

Figure 3:
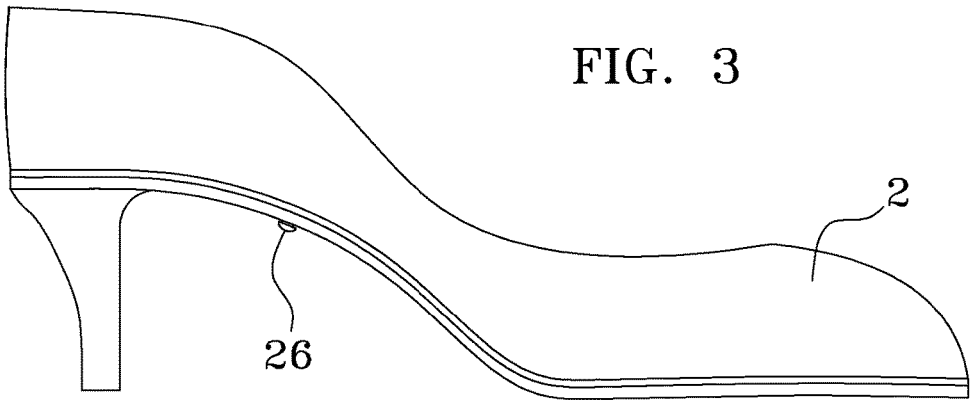
FIG. 3 is a side view of the convertible shoe in the high heeled mode.

As used herein, the terms refer to the parts of a shoe and are well known in the industry.

Breast: The forward facing part of the heel, under the arch of the sole.

Feather: The part of the shoe where the upper's edge meets the sole.

Heel: The part of the sole that raises the rear of the shoe in relation to the front.

Heel Cap: The part of the heel that contacts the ground. Also called the top piece.

Insole: A layer of material that sits inside the shoe that creates a layer between the outsole (or any intervening soles e.g. midsole) and the wearer's foot Outsole: The exposed part of the sole that is contact with the ground.

Seat: Where the heel of the foot sits in the shoe.

Shank: A piece of rigid material inserted somewhere between the outer face of the sole and the inner face of the insole, to as to cause the sole assembly to lie against the arch of the foot.

Sole Assembly: The entire part of the shoe that sits below the wearers foot. The upper, sole and heel make up the whole of the shoe.

Upper: The entire part of the shoe that covers the foot.

Welt: A strip of material that joins the upper to the sole. It may also be the midsole or eliminated in certain shoe designs.

DETAILED DESCRIPTION

When one shifts from walking on low heels to high heels the foot bends at the metatarsophalangeal joints located between the base of the proximal phalanx bones and the head of the metatarsal bones. The plantar fascia is then stretched beneath the tarsal bones. Thus, less of the weight of the person is carried by the calcaneus bone and more of the weight is carried by the metatarsal bones. Like walking on tip toes, this leaves this plantar fascia under tension. Over periods of time, this tension fatigues the foot. For this reason, high heeled shoes generally have a support shank made of a rigid material that runs down the longitudinal centerline of the shoe to transfer some of the load off of the heads of the metatarsal bones and back onto the remainder of the foot's bone structure. The support shank also generally has a slight arc along its length that serves to flex the plantar fascias slightly and reduce the point stress at its center. In normal walking, whether in high heels or low heels, the foot must flex and bend at the metatarsophalangeal joint. For this reason (to allow the flexing of the shoe with the foot) the support shank's proximal end begins somewhere behind the base of the proximal phalanx bones and its distal end terminates somewhere under the calcaneus bone. For obvious reasons this support shank must both be thin (to keep the thickness of the outsole/midsole/insole assembly to a minimum) and lightweight (to keep leg fatigue to a minimum). In a high heeled shoe the proximal end of the support shank begins just behind the base of the proximal phalanx bones, while in a low heeled shoe, the proximal end of the support shank is located further away from the base of the proximal phalanx bones and the distal end is located closer to the back of the calcaneus bone. So when walking in low heels the support shank shifts some of the load from the front of the foot and when walking in high heels the support shank shifts some of the load from the back of the foot. It also helps the shoe keep its overall shape, so that the heel cap meets the ground evenly across its face.

The longitudinal arc that the support shank traces varies with the shoe design and the height of the heel, but minimally. Without the support shank the shoe would quickly break down and walking would become tedious and uncomfortable. Simply said, the support of the foot must be moved more forward, toward the metatarsophalangeal joints as the height of the heel increases to properly support both the foot and the shoe's body. For this reason the structural design of high heeled shoes and low heeled shoes necessitates different internal placements of the support shaft.

The present invention allows the conversion between high heeled and low heeled shoes by internally altering and then locking the position of the support shank between the outsole and the insole.

Figure 4:
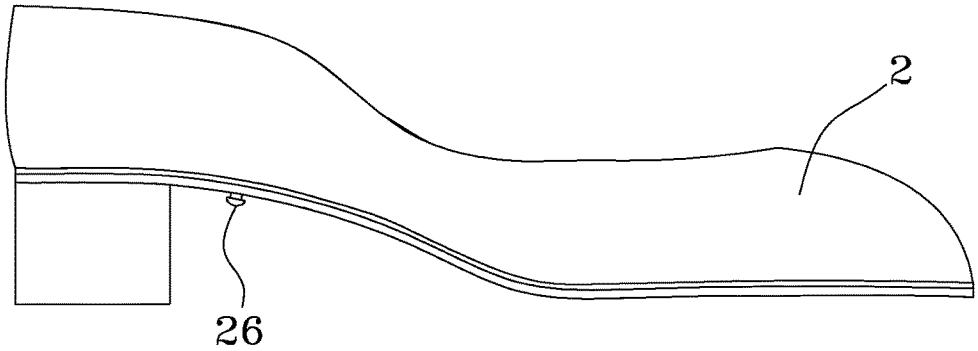
FIG. 4 is a side view of the convertible shoe in the low heeled mode.
Figure 5:
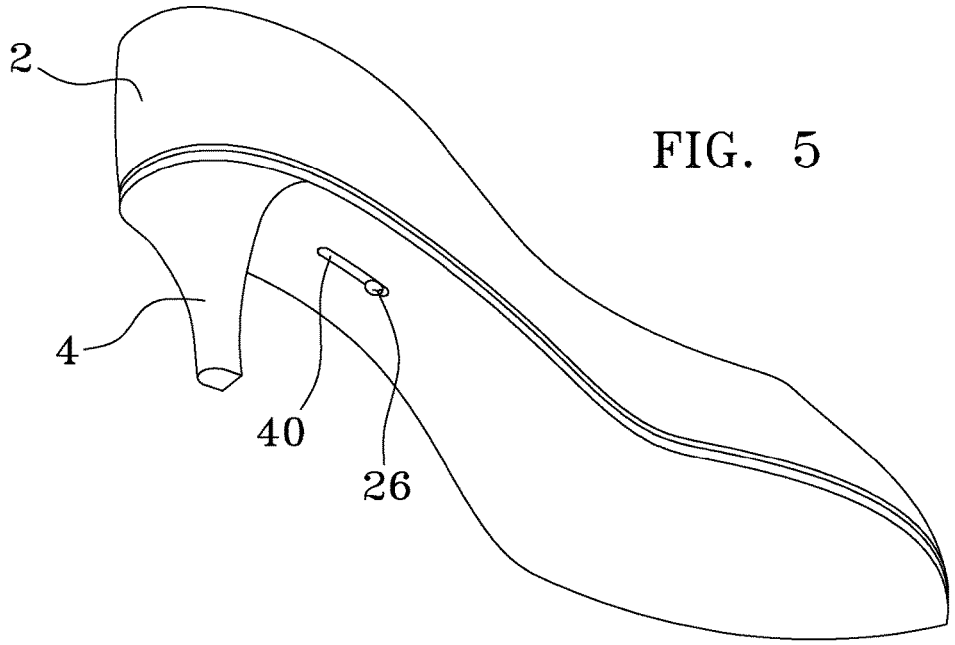
FIG. 5 is a bottom perspective view of the convertible shoe in the high heeled mode.
Figure 6:
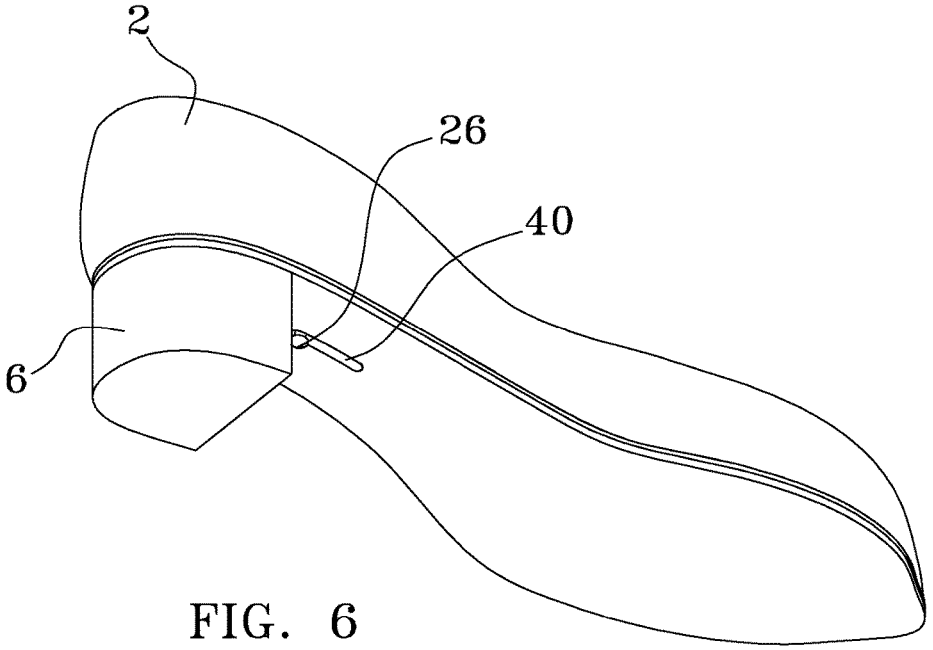
FIG. 6 is a bottom perspective view of the convertible shoe in the low heeled mode.

Looking at FIGS. 1, 3 and 5 the general outward appearance of the convertible shoe in the high-heeled mode can best be seen. Looking at FIGS. 2, 4 and 6 the general outward appearance of the convertible shoe in the low-heeled mode can best be seen.

Figure 7:
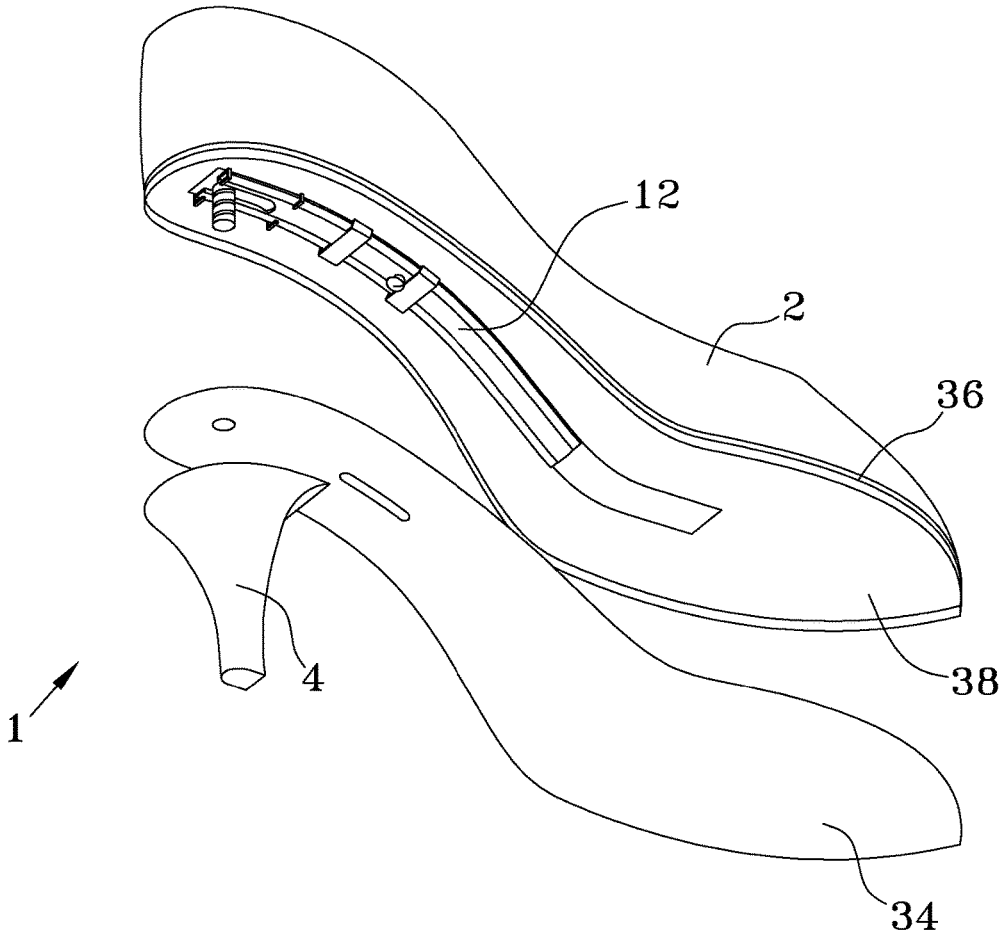
FIG. 7 is a bottom perspective exploded view of the convertible shoe in the high heeled mode.

The convertible shoe 1 has an upper 2, a sole assembly 8, and a lockable sliding shank assembly 12 (FIG. 7), a shank locking means, a removable high heel 4, a removable low heel 6 and a heel locking means 14. The heels 4 and 6 are interchangeable and utilize the same locking means for securement to the shoe 2. The upper 2 is lasted and affixed to the sole assembly 8 as per conventional shoe fabrication methodology and is well known by one skilled in the field of shoemaking.

Figure 9:
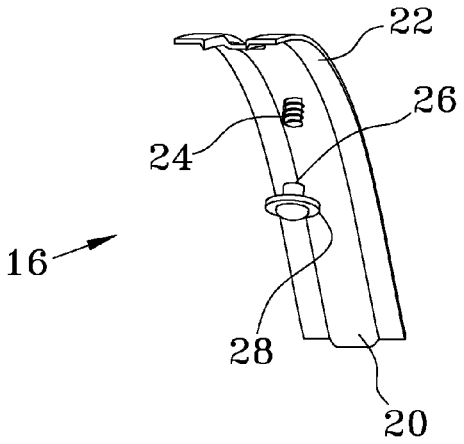
FIG. 9 is a front perspective of the sliding support shank showing the locking/adjustment lever.
Figure 10:
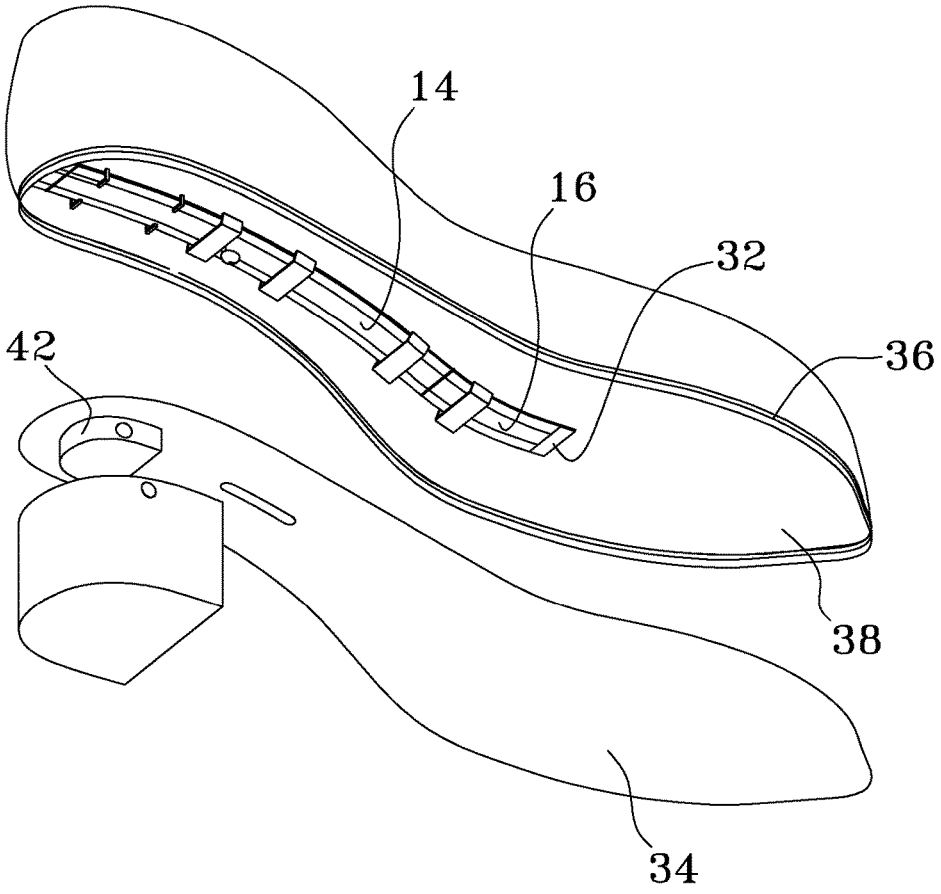
FIG. 10 bottom perspective exploded view of the convertible shoe in the low heeled mode with an alternate heel locking mechanism.
Figure 11:
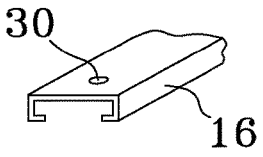
FIG. 11 is a perspective view of the support shank track.

The lockable sliding shank assembly 12 consists of a rigid shank 14, a track 16 and a shank locking means. Generally, these will each be of a rigid material such as metal, steel or a polymer. Looking at FIG. 9 it can be seen that the shank 16 is a linear curved member contoured for sliding operation tracing the arch of the specific shoe it is mated to. Although it is known that this shank 16 may simply be a solid steel bent plate as in most shoes, in the preferred embodiment the shank 16 will be of a thinner fabrication and have a non linear axial cross section. This corrugated style configuration, adds strength with a reduction in weight. Taking into consideration FIGS. 9, 10 and 11 together it is understood that the shank 16 has a central raised rib 20 flanked on either side by a depressed flange 22. Extending normally from the central rib 20 is the shank locking means which in the preferred embodiment is a threaded stud 24 that threadingly engages the internal thread on the locking lever 26. The locking lever 26 has a widened head with a flange 28 extending therefrom. In alternate embodiments there is a plethora of other styles and types of locking mechanisms that may be used with or separately from the lever, as is well known in the field of art.

The track 16 may take different structural configurations as is well known in the industry, however in the preferred embodiment it resembles a "T track". The depressed flanges 22 reside under the edges of the track 16 and serve as the sliding contact interface between the shank 14 and the track 16. The track may be affixed in the sole assembly 8 by gluing, stitching, mechanical fastening (see provided orifices 30) or other conventional, well known methods. The ends of the track 16 have caps 32 under which the distal or proximal ends of the shank 14 will reside when the shoe 1 is in the high-heeled or low-heeled configuration. This mechanically prevents any separation between the shank 14 and the track 16 at their ends, functionally strengthening the sliding shank assembly 12 during walking.

Figure 8:
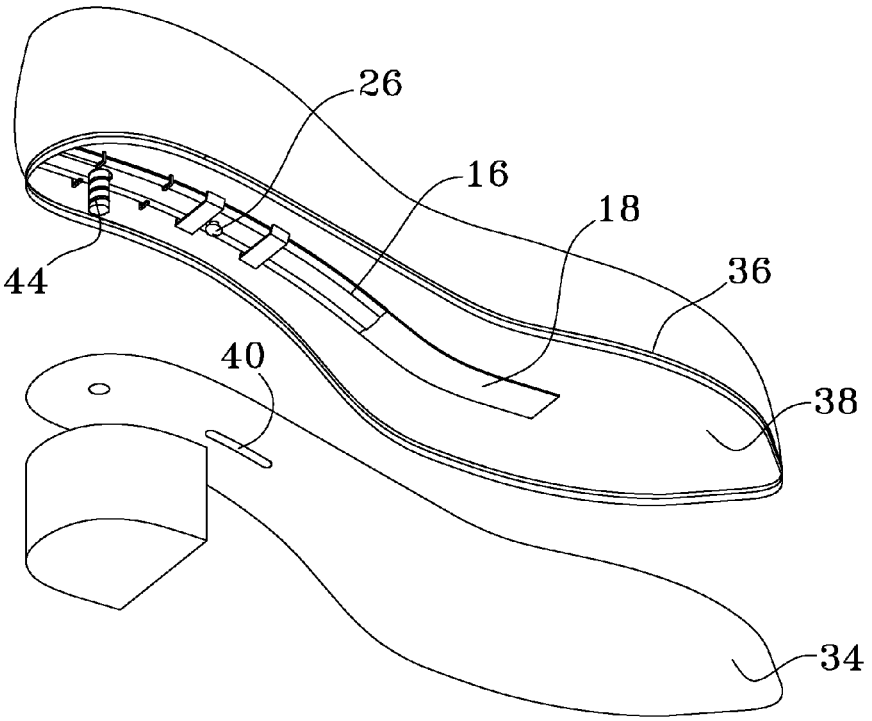
FIG. 8 is a bottom perspective exploded view of the convertible shoe in the low heeled mode.

Looking at FIG. 8, the sole assembly 8 has at a minimum an outer sole 34 and an inner sole 36 bonded together, but may optionally contain a midsole 38 (or a welt) bonded on one of its faces to the outer sole 34 and bonded on its other face to the inner sole so as to join the inner sole, midsole and outer sole into the sole assembly 8. In the preferred embodiment the track 16 and shank 14 reside in the midsole 38, although as discussed herein, their placement will vary within the sole assembly 8 depending on the shoe's design. The outer sole 34 has a slot 40 through which the threaded stud 24 can pass to threadingly engage the locking lever 26.

The sole assembly 8 may attach to either heel through a plethora of means all of which are well known by one skilled in the art. Two such methods are discussed and illustrated herein. In the preferred embodiment (FIG. 10) the outer sole 34 has a raised detent 42 that conforms to a matingly conforming depression formed in the top of the heel. Both the heel and the raised detent 42 have orifices therein that align upon assembly to accept a locking pin. In alternate embodiments (FIG. 8) a threaded pin 44 that passes through an aligned orifice in the outer sole 34 matingly engages a threaded recess in the heel. Similar style bayonet pins/fittings may be substituted.

In alternate embodiments, depending on the materials and design of the sole assembly 8, the track 16 may be eliminated and replaced by a groove 18 (FIG. 8) partially or fully formed in the outsole, midsole, insole or any combination thereof. This track will be sized to allow for the sliding, lockable movement of the shank 14 therein. Generally the elimination of the track and substitution of a groove works well with thicker sole assemblies 8 made of very resilient, materials.

In operation, the wearer selects the high-heel mode or the low-heel mode. If the low-heeled mode is desired, low heel 6 is affixed over the raised detent 42 and a locking pin is inserted into the aligned orifices. The locking lever 26 is slid toward the back (heel side) of the shoe 1. This causes the shank 14 to slide in the track 16 until the distal end of the shank reaches the distal end of the track 16 and resides under the rear cap (not visible in the perspective drawings of FIGS. 8 and 10). The shank locking lever 26 is then screwed down tight such that its flange 28 frictionally engages the outer sole 34 securing the shank 14 in the low heel position. (Although it is to be noted that the action of walking, once the appropriate heel for the shank position button is installed, acts to keep the shank 14 in its position. The locking feature of the lever 26 is a redundant feature and need not be utilized in all embodiments.) To switch to the high-heeled mode the heels are swapped by the reverse process, the lever 26 is unlocked and slid toward the front (toe side) of the shoe 1, until the proximal end of the shank 14 resides under the front cap 32. The lever 26 is screwed tight.

The process as described for the low-heeled mode, above moves the shank 26 resulting in the shoe's arch support shifting from under the metatarsophalangeal joints further back in the shoe 1 under the calcaneus bone so as to allow more of the weight to be carried by the metatarsal bones and supporting the middle of the plantar fascia.

Many styles of shoes incorporate the thickness of the sole into the design "look" and use platforms (thick midsoles) while other styles focus on minimalization and keep the sole to a minimal thickness, eliminating any midsoles. For this reason, although the preferred embodiment illustrates the support shank track 16 and support shank 14 in the midsole 38, they may alternately be located in the insole 36 or outsole 34 or in any combination of the three sole parts. Its best location will be apparent when viewing the actual shoe.

In a similar manner, the system/mechanism for swapping the high and low heels will be dictated by the design of the shoe. While illustrated with a simple threaded centrally located pin 44, there is a plethora of heel locking devices from locking plates, dovetailed bases, moveable pins, bayonet fittings and the like that would be well known by one skilled in the art.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A height adjustable shoe comprising:

a sole assembly made of an outer sole bonded to an inner sole;

an upper, affixed to a top face of said sole assembly;

a track affixed in said sole assembly;

a rigid shank engageable within said track for sliding movement;

a heel locking means on said sole assembly;

a high heel removeably attachable to said sole assembly;

a low heel removeably attachable to said sole assembly; and a shank locking means affixed to said shank and extending through said outer sole assembly wherein said shank locking means comprises a threaded stud that extends from said shank, through a slot formed through said outer sole, and is mechanically affixed to a locking lever; and wherein said track resides in said inner sole and wherein said slot formed through said outer sole slidingly accommodates said shank locking means.

2. The height adjustable shoe of claim 1 wherein said heel locking means comprises a threaded stud extending from said sole assembly and a threaded recess in said high heel and said low heel for mating engagement with said stud.

3. The height adjustable shoe of claim 1 wherein said heel locking means comprises a raised detent extending from said sole assembly, a matingly conformed depression in said high heel and said low heel, and a pin engageable through a pair of aligning orifices in said detent and said high heel or said detent and said low heel.

4. The height adjustable shoe of claim 1 wherein said locking lever is a threaded body with a flange extending therefrom for frictional engagement with said outer sole.

5. A height adjustable shoe comprising:

a sole assembly made of an outer sole bonded to a first face of a midsole and an inner sole bonded to a second face of the midsole;

an upper, affixed to a top face of said sole assembly;

a groove formed in said sole assembly;

a rigid shank engageable within said groove for sliding movement;

a heel locking means on said sole assembly;

a high heel removeably attachable to said sole assembly; and a low heel removeably attachable to said sole assembly;

a shank locking means affixed to said shank and extending through said outer sole assembly.

6. A height adjustable shoe comprising:

a sole assembly made of an outer sole bonded to an inner sole;

an upper, affixed to a top face of said sole assembly;

a groove formed in said sole assembly;

a rigid shank engageable within said groove for sliding movement;

a heel locking means on said sole assembly;

a high heel removeably attachable to said sole assembly;

a low heel removeably attachable to said sole assembly;

a shank locking means affixed to said shank and extending through said sole assembly wherein said shank locking means comprises a threaded stud that extends from said shank, through said outer sole, and that is mechanically affixed to a locking lever; and wherein said groove resides in said inner sole and wherein there is a slot formed through said outer sole to slidingly accommodate said shank locking means.

7. The height adjustable shoe of claim 6 wherein said locking lever is a threaded body with a flange extending therefrom for frictional engagement with said outer sole.

* * * * *